US005180126A

United States Patent [19]

Bennett

[11] Patent Number: 5,180,126

[45] Date of Patent: Jan. 19, 1993

[54] LEAF CADDY

[76] Inventor: Charles O. Bennett, 102 Ridge Rd., Benton, La. 71006

[21] Appl. No.: 814,419

[22] Filed: Dec. 24, 1991

[51] Int. Cl.[5] ..... B65B 67/04

[52] U.S. Cl. ..... 248/99; 248/97

[58] Field of Search ..... 248/99, 97, 95, 100, 248/101, 98, 455; 220/404; 141/314, 391

[56] References Cited

U.S. PATENT DOCUMENTS

| | | | |
|---|---|---|---|
| 578,091 | 3/1897 | Cain | 248/99 X |
| 2,995,329 | 8/1961 | Talcott, Jr. | 248/97 |
| 4,783,031 | 11/1988 | Ebentheuer | 248/97 |
| 4,856,740 | 8/1989 | MacLeod et al. | 248/99 X |
| 4,981,274 | 1/1991 | McKay et al. | 248/99 |

*Primary Examiner*—Ramon O. Ramirez
*Attorney, Agent, or Firm*—John M. Harrison

[57] ABSTRACT

A leaf caddy characterized in a preferred embodiment by a bag support frame fitted with telescoping side frame members for adjusting the dimensions of the frame and a pivoting knuckle which carries a fixed or telescoping support for orienting the frame in a desired position. The frame is designed to receive and mount the mouth of a plastic bag of selected size, wherein the mouth or lip of the bag is attached to the frame by tension in the frame and contact between the bag lip, the pivoting knuckle and the support.

12 Claims, 2 Drawing Sheets

LEAF CADDY

BACKGROUND OF THE INVENTION

1. Field of the Invention

This invention relates to devices for assisting in loading plastic bags with trash, debris and the like and more particularly, to a leaf caddy which is characterized in a first preferred embodiment by an adjustable frame fitted with telescoping side members for adjusting the circumference of the frame to fit plastic bags of various size. The frame may alternatively be fixed and also includes a pivoting knuckle adapted to receive a fixed or telescoping support for orienting the frame on the ground or in alternative selected positions for receiving the bag mouth and depositing leaves, trash and the like in the bag, while maintaining the mouth of the bag in an open configuration. In a preferred embodiment the mouth of the bag is secured to the frame by tension exerted through operation of the telescoping side frame members and engagement of the bag at one point with the support and the pivoting knuckle.

2. Description of the Prior Art

Various types of apparatus and devices are known in the art for assisting in the use of plastic trash bags by opening the mouth of the bags and more efficiently deposit leaves, trash and the like in the bags. Most of these devices are designed to maintain the mouth of the bag in an open condition to facilitate use of both hands while depositing the leaves, trash or other material in the bag. Typically, these devices include pivoting metal frames adapted to open and stand in an upright position and receive a bag of selected dimension between the frame legs, the mouth of the bag being supported on the top rails of the frame by means of multiple clips. The bag is thus maintained in open, upright configuration for filling with leaves, trash and the like, without the necessity of carrying the bag to various locations and maintaining the mouth of the bag open with one hand, while depositing the trash or other material in the bag with the other hand. Another trash bag receptacle device is marketed by Idea Development, Inc., of Worthing, S.Dak., as a "Super Sweep". The "Super Sweep" includes a main frame of selected dimension, an inner frame for snapping into the main frame and fitting the mouth or rim of a plastic bag to the main frame and a dust pan mounted on the bottom of the main frame, wherein the main frame can be placed on the ground or flat on a floor and material swept across the dust pan, through the main frame and into the connected bag. An auxiliary handle is provided for fitting into the underside of the main frame as a support leg, under circumstances where the main frame is propped against a fence, tree or other support to create a stationary trash receptacle.

It is an object of this invention to provide a new and improved leaf caddy which is simple in design, adapted in a preferred embodiment to adjustably accommodate plastic bags of various size and may be positioned in a variety of configurations for use in receiving, mounting and loading trash bags with leaves, trash and other material.

Another object of this invention is to provide a leaf caddy for mounting trash bags into trash-receiving configuration, which leaf caddy includes a frame having adjustable side members for perimeter adjustment to accommodate trash bags of varying size, a pivoting knuckle provided on a top frame member for removably receiving a fixed or telescoping support and both securing a trash bag on the frame and supporting the frame in functional configuration to facilitate filling the trash bag with leaves, trash or other material.

Yet another object of this invention is to provide a light-weight, adjustable frame for receiving the lip, edge or mouth of trash bags of various configuration and mounting the trash bags individually on the frame in tension relationship, which frame further includes top and bottom frame members, telescoping side members connecting the top and bottom frame members and a pivoting knuckle provided on the top frame member for removably receiving a fixed or telescoping support and engaging a small area of the lip or mouth of the bag to aid in securing the bag on the frame.

SUMMARY OF THE INVENTION

These and other objects of the invention are provided in a new and improved leaf caddy for quickly and easily mounting a plastic trash bag of selected size and positioning the trash bag for filling with leaves, trash and other material without the requirement of supporting the trash bag with one hand. In a preferred embodiment the leaf caddy includes a light-weight frame having top and bottom frame members and telescoping side members connecting the ends of the top and bottom frame members, for accommodating a trash bag of selected size and a pivoting knuckle attached to the top frame member for removably receiving a support and engaging a small area of the lip of the trash bag to help mount the trash bag, support the frame and orient the trash bag for receiving leaves, trash and other material.

BRIEF DESCRIPTION OF THE DRAWING

The invention will be better understood by reference to the accompanying drawings, wherein.

DESCRIPTION OF THE PREFERRED EMBODIMENTS

Figure 1:
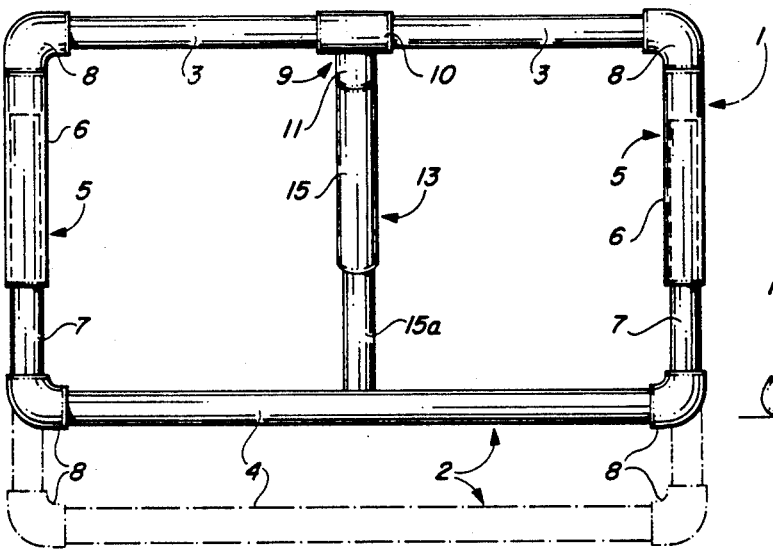
FIG. 1 is a front view of a first preferred adjustable frame embodiment of the leaf caddy of this invention.
Figure 2:
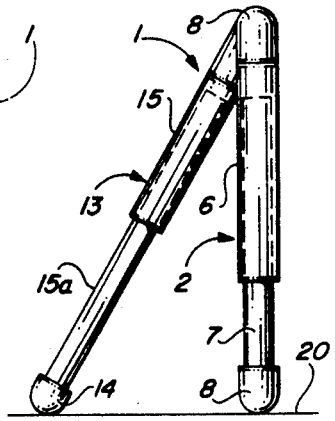
FIG. 2 is a side view of the leaf caddy illustrated in FIG. 1.

Referring initially to FIGS. 1 and 2 of the drawings, a most preferred embodiment of the leaf caddy of this invention is generally illustrated by reference numeral 1. The leaf caddy 1 includes a generally rectangular-shaped frame 2, defined by a top frame member 3 and a bottom frame member 4, the ends of which are spanned by spaced, adjustable side frame members 5. The frame 2 may be constructed of a plastic material such as polyvinylchloride (PVC) pipe and elbow fittings 8 are used to connect the respective top frame member 3, side frame members 5 and bottom frame member 4, for purposes of illustration. The side frame members 5 are each characterized by a receiving tube 6 and a telescoping tube 7, one end of each receiving tube 6 of which is secured to opposite ends of the top frame member 3 by means of elbow fittings 8, while one end of each of the telescoping tubes 7 is secured to opposite ends of the corresponding bottom frame member 4, also by elbow fittings 8. The unsecured ends of the telescoping tubes 7 are inserted in tight, but adjustable, telescoping relationship inside the corresponding ends of the respective receiving tubes 6, to facilitate adjustment of the size of the frame 2 by extension and retraction of the telescoping tubes 7 and displacement of the bottom frame member 4 with respect to the top frame member 3, as illustrated in phantom by the arrows in FIG. 1.

Figure 3:
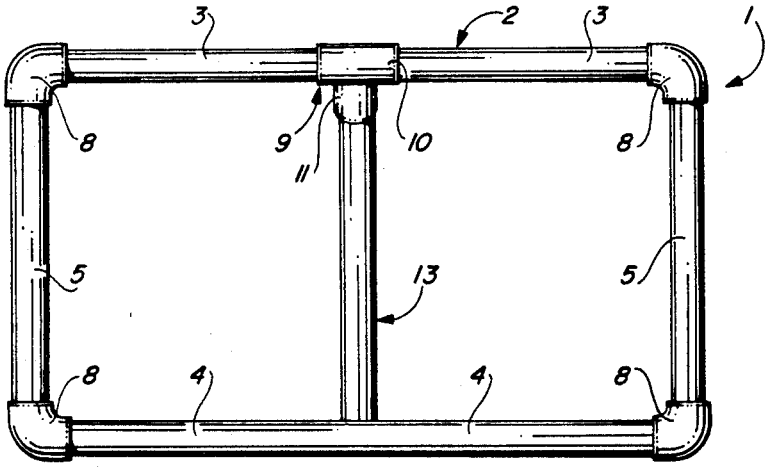
FIG. 3 is a front view of a second preferred fixed frame embodiment of the leaf caddy.

As further illustrated in FIGS. 1-3 of the drawings, the frame 2 may be rigid, as illustrated in FIG. 3, and the top frame member 3 in each case is fitted with the frame leg element 10 of a T-shaped pivoting knuckle 9. Accordingly, the frame leg element 10 pivots with application of force on the top frame member 3 and the T-leg 11 of the pivoting knuckle 10 projects outwardly of the frame leg 10, as illustrated. One end of an elongated support 13 is removably inserted in the T-leg 11 of the pivoting knuckle 9 as illustrated in FIG. 3, to facilitate support of the frame 2 on a supporting surface 20, in the position illustrated in FIG. 2. Alternatively, the support 13 may be designed in telescoping fashion, with a top support segment 15 and a telescoping bottom support segment 15*a*, as illustrated in FIG. 1. Accordingly, the support 13 can be rotated with the pivoting knuckle 10 to any selected angle with respect to the vertical, as further illustrated in FIGS. 1-4. Furthermore, a friction cap 14 may be inserted on the opposite end of the support 13 or bottom support segment 15*a* to secure the support 13 in functional position as a prop to support the frame 2 in a selected angular relationship on the ground or other supporting surface 20.

Figure 4:
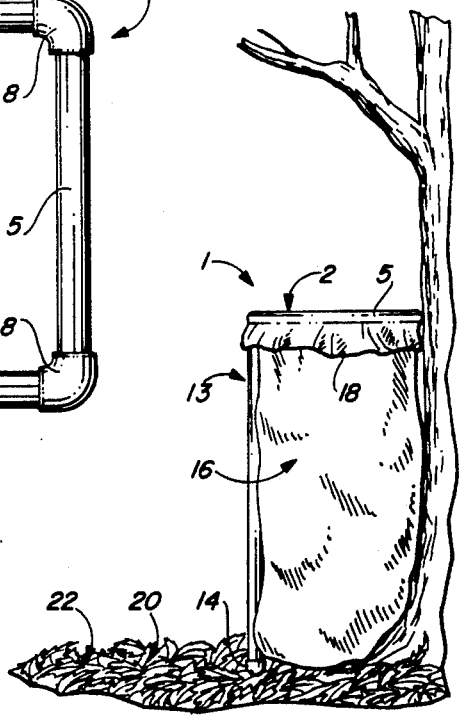
FIG. 4 is a side view of a typical functional orientation of the leaf caddys illustrated in FIGS. 1–3 with a plastic trash bag in place.
Figure 5:
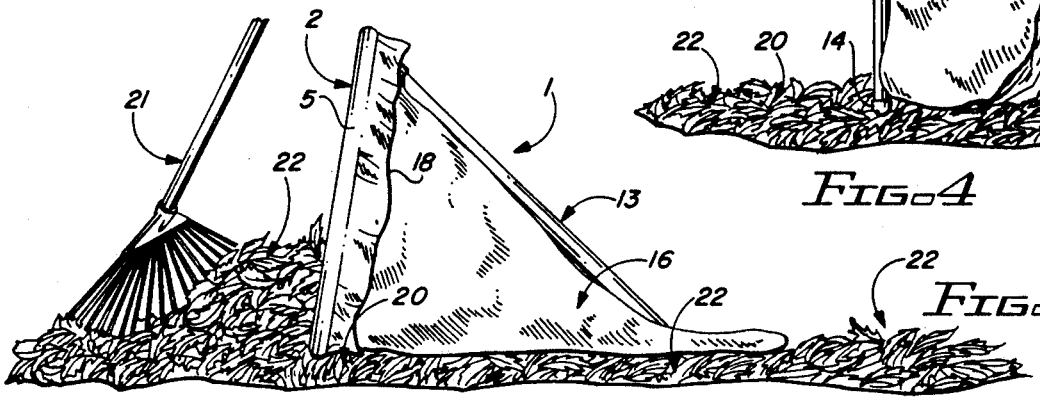
FIG. 5 is a side view of an alternative functional orientation of the leaf caddy illustrated in FIGS. 1–3, with a plastic trash bag in place.
Figure 7:
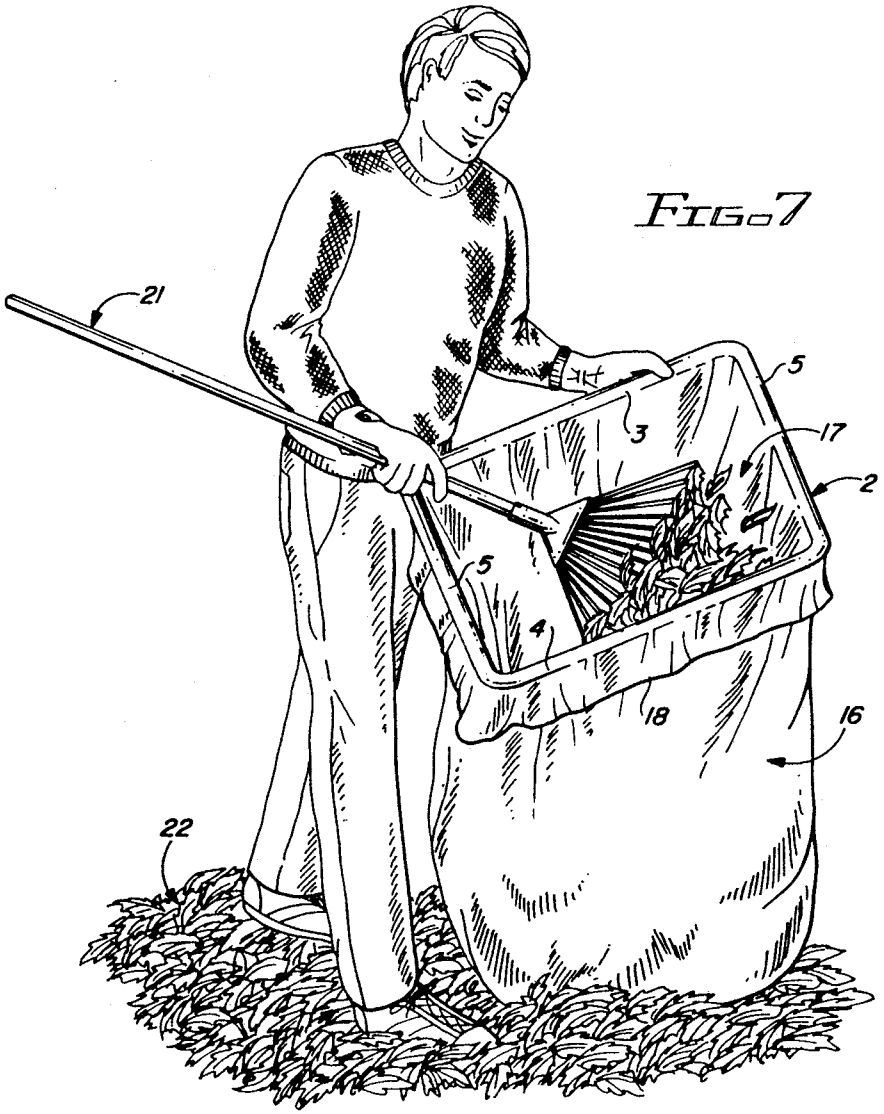
FIG. 7 is a perspective view of a variation of the leaf caddy orientation in FIG. 6.
Figure 6:
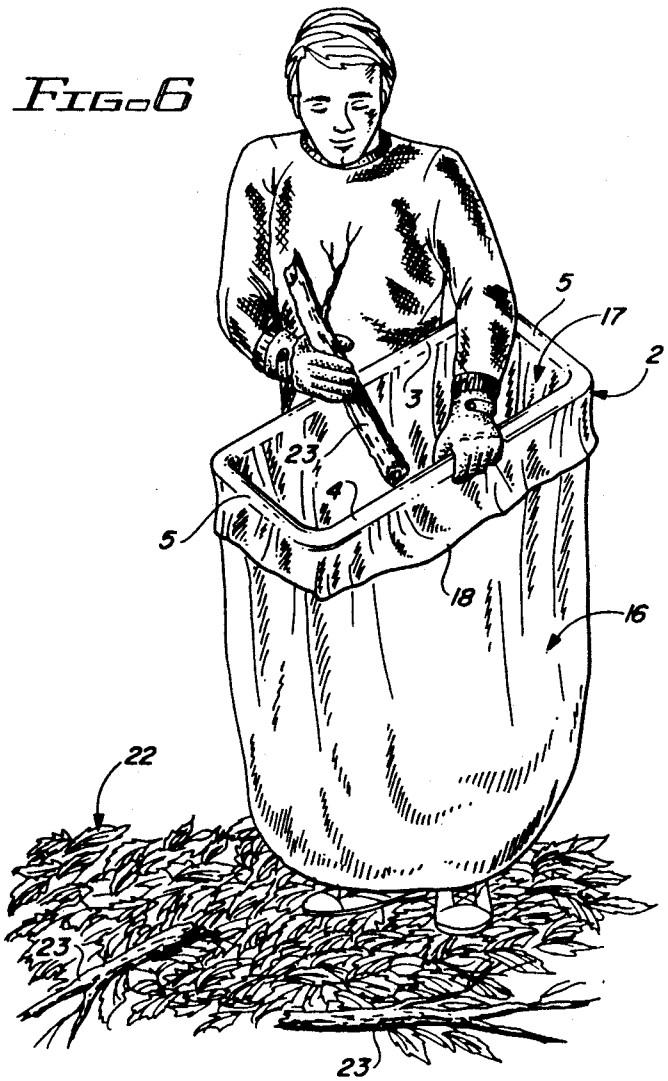
FIG. 6 is a perspective view of yet another alternative functional orientation for the leaf caddy.

Referring now to FIGS. 4-7 of the drawings, the bag mouth 17 of a conventional plastic bag 16 may be attached to the frame 2 of the leaf caddy 1 by first removing the support 13 from the T-leg 11 of the pivoting knuckle 9 and subsequently fitting the bag mouth 17 of the plastic bag 16 around the top frame member 3, bottom frame member 4 and side frame members 5. If the bag mouth 17 is larger than the circumference of the frame 2, the side frame members 5 illustrated in FIG. 1 can be telescopically adjusted by extending the telescoping tubes 7 from the corresponding receiving tubes 6 and thereby adjusting and enlarging the perimeter of the frame 2 until sufficient mounting tension is applied to the bag mouth 17. When sufficient tension is applied to retain the bag edge 18 of the bag mouth 17 at least about two to four inches over the frame 2, the support 13 is then fitted into the T-leg 11 of the pivoting knuckle 9, forcing a small portion or segment of the bag mouth 17 into the T-leg 11, to further secure the bag mouth 17 of the plastic bag 16 on the frame 2. The body of the plastic bag 16 is then deployed from the frame 2 with the bag mouth 17 in engaged configuration, as illustrated in FIGS. 4-7 and the support 13 can be used to support the frame 2 and bag mouth 17 in an upright or angular configuration for receiving trash, debris or other material such as leaves 22, as illustrated in FIGS. 4 and 5. Under circumstances where the frame 2 is larger than the bag mouth 17 of the plastic bag 16, the side frame members 5 are telescopically retracted to reduce the perimeter of the frame 2 and facilitate fitting of the frame 2 inside the bag mouth 17. The frame 2 is then readjusted as described above, to mount the plastic bag 16 on the frame 2 in a tension fit. It will be appreciated that the frame 2 may be alternatively horizontally oriented and leaned against a tree, as illustrated in FIG. 4, or carried by the user to retrieve and deposit leaves 22, as well as trash and other debris or material such as sticks 23, located at various points which are remotely located from each other, as illustrated in FIGS. 6 and 7, with or without the use of a broom 21. Under circumstances where a rigid frame 2, illustrated in FIG. 3, is used, the frame 2 is constructed slightly larger than a plastic bag of desired size to facilitate mounting and maintaining the bag mouth 17 on the frame 2 in a tension fit without the necessity for adjusting the frame 2.

In a preferred embodiment of the invention and referring again to FIGS. 1 and 2 of the drawings, each telescoping tube 7 is only slightly smaller in diameter than the corresponding receiving tube 6 in the respective side frame members 5, to facilitate a friction fit of each telescoping tube 7 in the corresponding receiving tube 6. Accordingly, a selected fine adjustment of the telescoping tubes 7 in the corresponding receiving tubes 6 can be effected to compensate for plastic bags 16 having a bag mouth 17 of various size, by manipulating each telescoping tube 7 with respect to the companion receiving tube 6. Alternatively, it will be appreciated by those skilled in the art that the telescoping tubes 7 may be spring-loaded in the corresponding receiving tube 6 and suitable retainers (not illustrated) may be provided in the ends of the telescoping tubes 7, for engaging corresponding openings (not illustrated) in the receiving tubes 6 and adjusting the telescoping tubes 7 with respect to the receiving tubes 6 at selected increments, to adjust the frame 2 and accommodate plastic bags 16 having a bag mouth 17 of various size. Other techniques for adjustably mounting the telescoping tubes 7 in the receiving tubes 6 of the side frame members 5 may be made according to the knowledge of those skilled in the art.

It will be further appreciated by those skilled in the art that the leaf caddy 1 of this invention may be constructed of a variety of materials of construction, including plastic pipe such as polyvinylchloride (PVC), as heretofore described, or the like, wherein the top frame member 3 is connected to the receiving tubes 6 and the bottom frame member 4 to the telescoping tubes 7, respectively, by means of the elbow fittings 8 or like connectors. Under these circumstances, the pivoting knuckle 9 is preferably a PVC tee fitting having a frame leg 10 of sufficient internal diameter to pivotally mount with a friction fit on the top frame member 3 and a T-leg 11 of appropriate size to tightly, but removably, accommodate the support 13. Alternatively, the respective elements of the frame 2 may be constructed of aluminum, fiberglass, wood or other selected material of construction having cylindrical or box tubing construction, according to the desires of the user.

It is understood that the frame 2 need not be configured in a rectangular shape, since the top frame member 3 and the bottom frame member 4 may be of dissimilar length to define a trapezoid, for example, as desired. Moreover, the side frame members 5 may be extended telescopically as described above to cause the frame 2 of the leaf caddy 1 to define a square.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A leaf caddy comprising a frame for receiving and mounting a trash bag; telescoping means provided in said frame for adjusting said frame to accommodate the trash bag; a substantially T-shaped knuckle pivotally carried by said frame in a friction-fit; and an elongated support having one end removably attached to said knuckle for orienting said frame on the supporting surface and filling the trash bag.

2. The leaf caddy of claim 1 wherein said support further comprises a top support segment carried by said knuckle and a bottom support segment telescoping in said top support segment and further comprising a friction cap provided on the opposite end of said bottom support segment for engaging the supporting surface.

3. The leaf caddy of claim 1 wherein said T-shaped knuckle further comprises a frame leg pivotally mounted on said top frame member and a tee leg extending from said frame leg for receiving said one end of said support.

4. The leaf caddy of claim 1 wherein said support further comprises a top support segment and a bottom support segment telescoping in said top support segment.

5. A leaf caddy for supporting the mouth of a plastic trash bag in open configuration on a supporting surface, comprising a generally rectangular frame characterized by a top frame member, a bottom frame member spaced from said top frame member in substantially parallel relationship and a pair of telescoping side frame members disposed in spaced, substantially parallel relationship for connecting the ends of said top frame member and said bottom frame member, respectively, said top frame member, said bottom frame member and said side frame members adapted for engaging the mouth of the trash bag in a tension fit and removably mounting the trash bag on said frame; knuckle means adjustably and pivotally carried by said top frame member; and an elongated support having one end adapted for engaging an area on the mouth of the trash bag and inserting said area and said one end of said support in said knuckle means and supporting said frame and the trash bag in a selected orientation on the supporting surface for filling the trash bag with trash.

6. The leaf caddy of claim 5 wherein said knuckle means further comprises a generally T-shaped knuckle having a frame leg tightly and pivotally carried by said top frame member and a tee leg adapted to removably receive one end of said support.

7. The leaf caddy of claim 5 further comprising a friction cap adapted for mounting on the opposite end of said support for engaging the supporting surface in friction-enhancing relationship.

8. The leaf caddy of claim 5 wherein said support further comprises a top support segment carried by said knuckle means and a bottom support segment telescoping in said top support segment.

9. The leaf caddy of claim 8 wherein said knuckle means further comprises a generally T-shaped knuckle having a frame leg tightly and pivotally carried by said top frame member and a tee leg adapted to removably receive one end of said top support segment.

10. A leaf caddy for mounting in the mouth of a trash bag and supporting the trash bag for filling with trash, comprising a substantially rigid frame characterized by a top frame member; a bottom frame member spaced from said top frame member in substantially parallel relationship; side frame members connecting the ends of said top frame member and said bottom frame member, respectively; a substantially T-shaped knuckle having a frame leg pivotally mounted on said top frame member and a tee leg projecting outwardly from said frame leg; and an elongated support having one end adapted for insertion in said tee leg and the opposite end of said support adapted for engaging a supporting surface for supporting said frame and the trash bag at a selected angle with respect to the vertical when said bottom frame member is also positioned on the supporting surface.

11. The leaf caddy of claim 10 wherein said support further comprises a top support segment carried by said tee leg and a bottom support segment telescoping in said top support segment.

12. The leaf caddy of claim 10 further comprising a friction cap provided on the opposite end of said support for engaging the supporting surface.

* * * * *